United States Patent [19]

Tupper et al.

[11] 4,313,236

[45] Feb. 2, 1982

[54] SAFETY EQUIPMENT FOR BOATS

[75] Inventors: Alan W. Tupper, Weavers House, Castle Combe, Wiltshire; Peter R. Flux, Calne, both of England

[73] Assignee: Alan William Tupper, Castle Combe, England

[21] Appl. No.: 75,091

[22] Filed: Sep. 13, 1979

[51] Int. Cl.[3] ..... B63C 9/00

[52] U.S. Cl. ..... 9/14; 104/115; 104/182; 119/120; 182/3

[58] Field of Search ..... 9/14, 1.1; 114/39; 182/3; 104/182, 112, 115, 116; 191/76; 119/120

[56] References Cited

U.S. PATENT DOCUMENTS

| | | | |
|---|---|---|---|
| 364,669 | 6/1887 | Prentice | 104/182 |
| 1,429,007 | 9/1922 | Wilson | 104/182 |
| 2,540,868 | 2/1951 | Ehrhart | 104/182 |
| 3,193,050 | 7/1965 | Galante | 182/3 |
| 3,648,664 | 3/1972 | Hunley | 119/120 |
| 3,922,972 | 12/1975 | Junes | 104/112 X |
| 4,155,132 | 5/1979 | Lee | 9/14 |

FOREIGN PATENT DOCUMENTS

| | | | |
|---|---|---|---|
| 2736873 | 3/1979 | Fed. Rep. of Germany | 9/14 |
| 427886 | 7/1967 | Switzerland | 104/182 |

*Primary Examiner*—George E. A. Halvosa
*Attorney, Agent, or Firm*—Scully, Scott, Murphy & Presser

[57] ABSTRACT

The invention provides safety equipment to enable a person to work and move freely around on deck in all weathers while being securely attached to the boat and to enable recovery of a person overboard by other crew members. The equipment comprises a life-line secured along both sides of the boat. At the intermediate attachment points the life-line is secured by latchways which allow a lanyard hook clipped onto the life-line to traverse each such attachment point. When a person goes overboard, the drag force on the lanyard causes the lanyard hook to move to the aft-most stanchion from where the person overboard is towed and removed by other crew members. In another embodiment, the person overboard is towed by pendants at the stern of the boat. A hoist is provided to haul the pendant inboard for recovery of the person overboard.

3 Claims, 13 Drawing Figures

SAFETY EQUIPMENT FOR BOATS

FIELD OF THE INVENTION

This invention relates to safety equipment for use in small boats.

BACKGROUND OF THE INVENTION

It is already standard practice to provide safety harness for use by anyone on the deck of a boat, particularly a sailing craft. By means of a lanyard and hooks one can be clipped to secure points of the craft or specially rigged lifelines. This is not entirely satisfactory since movement about the deck is thereby considerably restricted, thus discouraging use of the equipment; danger exists whilst moving the attaching hook or clip from point to point and "strong" points in craft are prone to failure under stress.

It is also known to install a guard rail system of wires and stanchions around the periphery of boats decks in order to help obstruct falls overboard. However these systems provide only a modest degree of security because of inherent boat design limitations.

Given such fallible existing arrangements a boat has to be put about in order to recover a person who does fall overboard. This manoeuvre, particularly under sail, often presents extreme difficulty and is sometimes impossible in heavy weather, and is of course out of the question in a single-handed craft. Even if the manoeuvre is completed the task of hauling a person back into the boat in waterlogged clothing and perhaps unconscious will often present considerable difficulties.

SUMMARY OF THE INVENTION

According to the invention, there is provided safety equipment for a boat, which equipment comprises a life-line for location along a peripheral portion of a boat, the life line being secured, in use of the equipment, to a boat at a plurality of attachment points by fittings which hold the line so as to conform to any configuration required by marine design, to which life-line a person can be attached by means of a safety harness including a lanyard and an associated attachment means; and at least one traversing device for enabling a lanyard attachment means to traverse each intermediate line-attachment point in either direction whether the wearer is inboard or overside of the boat. The invention also provides a marine craft fitted with such safety equipment.

An advantage of the invention is that it makes it possible to provide equipment for use in small boats, particularly sailing craft, which enables anyone to work on deck in all weathers in a condition of continuous secured attachment to the boat, with ease and with confidence in his recovery either by the efforts of his crewmates or, in some embodiments, by an automatic system should he inadvertantly go overboard.

The life-line can be made of any suitable material, for instance a metal or a man-made fibre, and can be mono- or multi-strand. It must be strong enough to take all calculable strains with a good safety factor, and long enough so that when it is secured to the chosen terminal stanchions a person clipped to it will have access to the whole length of the boat.

It is in use attached to stanchions or other fittings securely bolted or otherwise secured to the deck or other part of the structure of the boat, at a suitable height which will keep the lanyard of the safety harness clear of deck gear as far as possible but not foul the sails, stays, etc. The stanchions are located at or near each end of the boat and at intermediate points along both sides as necessary to keep the life-line fairly taut.

In some embodiments, the traversing device which enables a lanyard to traverse a life-line attachment point such as a stanchion without fouling or jamming may be mounted on each intermediate stanchion so that any force in an outward and downward direction causes it to topple. Such a force would be exerted on the life-line by a man going overboard and the hook would be enabled to pass each traversing device in its reversed presentation to it. Preferably the latchways would be integrated into the design of the stanchions themselves. Traversing device of the type which can be used in embodiments of the present invention are described and claimed in my co-pending U.S. Application Ser. No. 021,967, now U.S. Pat. No. 4,265,179, which is incorporated herein by reference.

DETAILED DESCRIPTION

Figure 1:
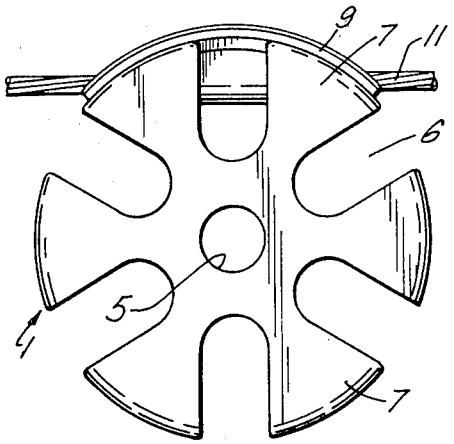
FIGS. 1 and 2 show a side and end view respectively of the main components of a traversing device which serves as a life-line attachment point to a stanchion, not shown on a boat.
Figure 2:
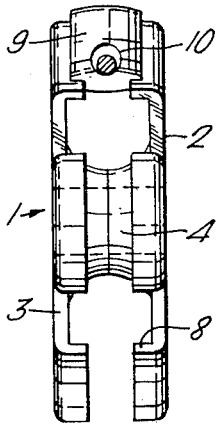
Figure 3:
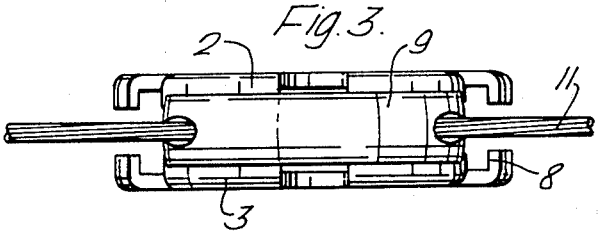
FIGS. 3 and 4 show a plan and sectional view.
Figure 4:
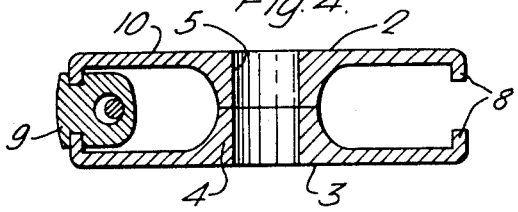
Figure 5:
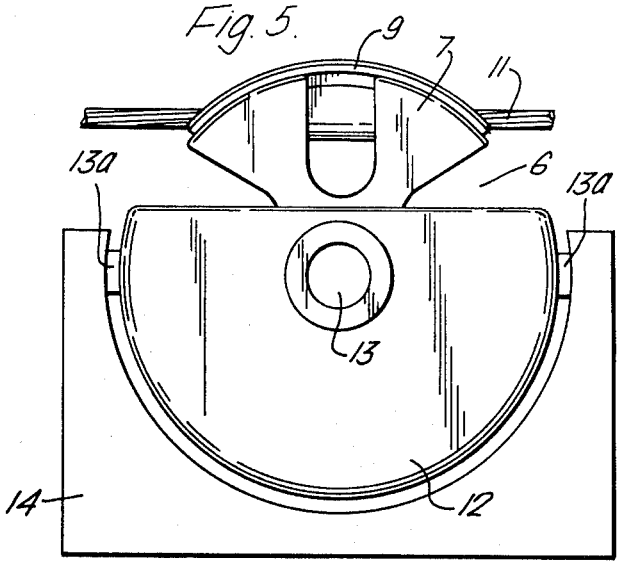
FIGS. 5 and 6 show side and end views respectively of a traversing device with a protective casing.
Figure 6:
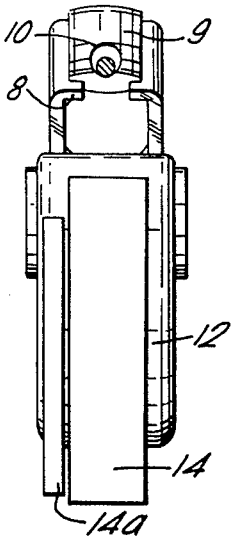

In the drawing a wheel 1 is made up of discs 2 and 3 with a central core 4 through which a hole 5 passes. The wheel is mounted by means of an axle through the hole 5 on a stanchion (not shown in FIGS. 1 to 4). Each disc has six U-shaped recesses 6 and corresponding triangular projecting parts 7 and each projecting part has a flange 8. A wire guide member 9 is grooved to fit flanges 8 as shown and has a longitudinal hole 10 through which a wire 11 being a life-line running from end to end on both sides of a boat, is passed. In FIGS. 5 and 6 a casing 12 is shown provided with bearings 13 for the shaft on which the wheel is mounted, and the casing is pivotally mounted by trunnions **13*a* on a housing 14 for attaching the device to a post, stanchion or other support fitting on a boat. The flange 14*a* on the casing 12 maintains the traversing device vertical when a person is located inboard but allows the traversing device to topple outwardly and downwardly when a person goes overboard as described with reference to FIG. 9**.

The number of recesses provided in the traversing device may be different in other embodiments depending on factors such as the possible loading on the traversing device. One particularly attractive embodiment is a four-leaf self-indexing traversing device in which the four projecting parts are rounded and shaped so that the wheel is rotated whenever engaged by a hook moving on the life-line whatever the angular position of the wheel, e.g. of the type illustrated in FIG. 10.

In use, when a hook slides from right to left (with reference to FIG. 1) along wire 11 it moves into recess 6 in reel 1. In doing so it comes into contact with projecting part 7 of the wheel and causes the wheel to rotate in a counter clockwise direction. As it does so part 7 moves away from the right hand end of guide 9 and the hook slides on to guide 9. It is moved over and along the guide, by the pull of the load. When part 7 clears the left hand end of the guide the hook moves on to the wire from the guide and the wheel is ready for the next traversing operation.

Figure 7A:
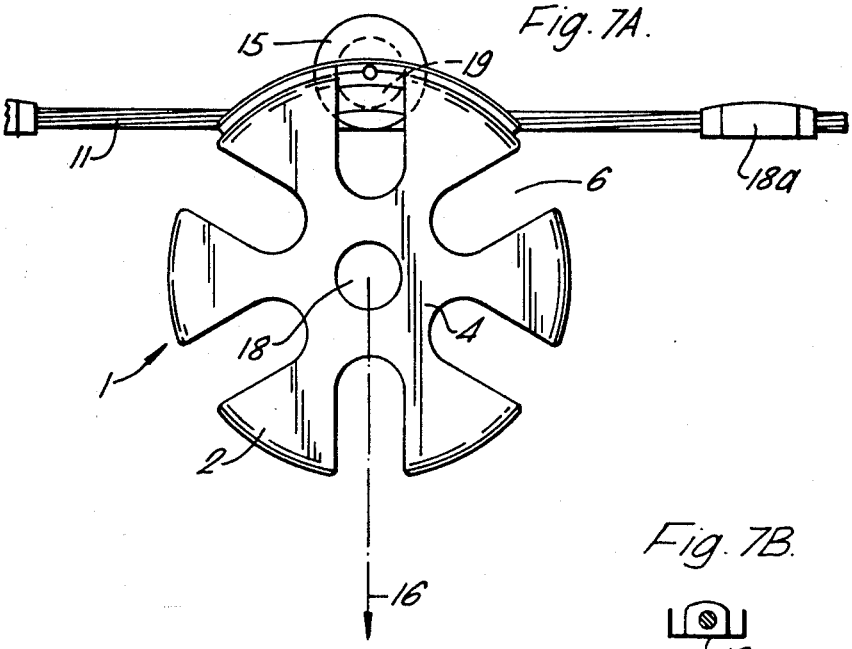
FIG. 7A shows another latchway attachment for a lanyard.
Figure 7B:
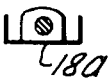
FIG. 7B is a detail of the traversing device attachment shown in FIG. 7A.

In another embodiment, instead of having a traversing device at each intermediate stanchion, a traversing device can be provided on the safety harness lanyard in addition to or in replacement of the safety hook. This traversing device will traverse simple attachment points 18*a* in a converse manner to that which has been described. An illustration of the principles of such operation is shown in FIG. 7A in which the guide 9 is fitted with a free-running wheel 15 and load 16 attached to axle 18 represents the lanyard attached to the man on deck. When a person goes overboard the latchway is re-oriented on the life-line as a result of the force applied thereto by the lanyard, in an outward and downward direction.

By means of the traversing device as described a person is secured to the life-line and is enabled to move along the whole length of the line without fouling either the attachment points or the deck gear, although he is held by only a relatively short lanyard.

Any suitable safety harness can be used, preferably one which is in conformity with B.S. 4224:1975. The length of the lanyard is kept as short as possible with reference to the dimensions of the boat and the hooks or clips which secure it to the harness and the life-line must be strong but detachable. In the embodiment in which the traversing device is located on the lanyard it can be in addition to or instead of the hook or clip.

The means for transferring the lanyard from the life-line to a towing pennant only comes into operation when a person wearing the harness goes overboard. The water drag on the person will cause the lanyard to move aft along the life-line past the attachment points whether it is attached to the life-line by means of a hook or traversing device. On reaching a selected position according to the rig of the boat the device at the end of the lanyard is brought into secure engagement with a hook which is connected by a fixed length wire pendant to a ring disposed on a selected part of the boat's standing rigging. The lanyard is then automatically released from the life-line to allow the man overboard to be towed astern from the said ring in a head-up position.

This aspect of tow angle which is determined by the height of the ring on the rigging, usually a back stay, will ensure safety from drowning for a person so deployed overboard from boats such as displacement sailing craft where the ultimate water speed is below 15 knots.

The means for recovering a person from the towed overboard situation is such as to enable one other person inboard to exert in favourable circumstances some 200 to 250 Kg lift in an upwards and onboard direction. Such a device may comprise a multi-part tackle alone or in combination with a simple purchase (such as a double whip), means for securely attaching the upper ends of the tackle or combination to a back stay or mast head of a boat, a container/guide tube through which the moving blocks and associated cordage can slide, a roller shackle to act upon a lanyard when secured by the pendant to the lower moving block and a lower fairlead ring with means for securing the said tube and ring to a back stay, which ring provides guiding means for the downhaul line of the tackle and a bight of a lanyard when it is being drawn up through the tube when the equipment is being used.

Suitable line tensioning means can be included, also caps for each end of the guide tube and cleats and blocks for guiding the downhaul line into the boat when it is being hauled in.

An essential dimension of the tackle/purchase combination is that sufficient fleeting length is available on the standing rigging to effect recovery in one deployment. This will normally be approximately one boat's length.

The tackle used must be light in weight, exposure-resistant yet sufficiently strong to withstand the weight and/or drag of a water-logged clothed person. An example of a suitable tackle is the "HALTRAC" Mini Hoist marketed by Messrs. Halfords which weighs 1 lb., has a breaking strain of 1500 lbs. and a recommended working load of 500 lbs. This would give a good margin over the loads likely to be experienced, particularly when used in combination with another tackle of suitable velocity ratio such as a double whip.

Further mechanical advantages by enhancement or substitution can be incorporated if required by such means as geared bollards, sheet winches, geared purchases, etc.

The tackle system can suitably be secured to the masthead by means of a wire pendant. The pendant is of such a length that the fleeting length of the system over the chosen standing rigging is roughly equal to the length of the life-line.

Alternatively recovery can be effected by the automatic or manual engagement of an electric winch upon a hoist system which is energized from either the boat's batteries or a separate battery system reserved for this purpose. Such an alternative would be required for a single-handed yachtsman.

Additionally the forces brought into play on the equipment described, such for example as those upon the back-stay tow ring when the weight of the person is taken up, are such as to allow for the simple automatic triggering of such ancillary rescue devices as air blast klaxons to alert the crew off watch, deck illumination and so on.

A fundamental feature of the invention is that upon falling overboard, a person retains throughout a secure attachment to the boat, thus eliminating the need for the difficult and hazardous manoeuvre of putting the boat about in order to effect his recovery.

Figure 8:
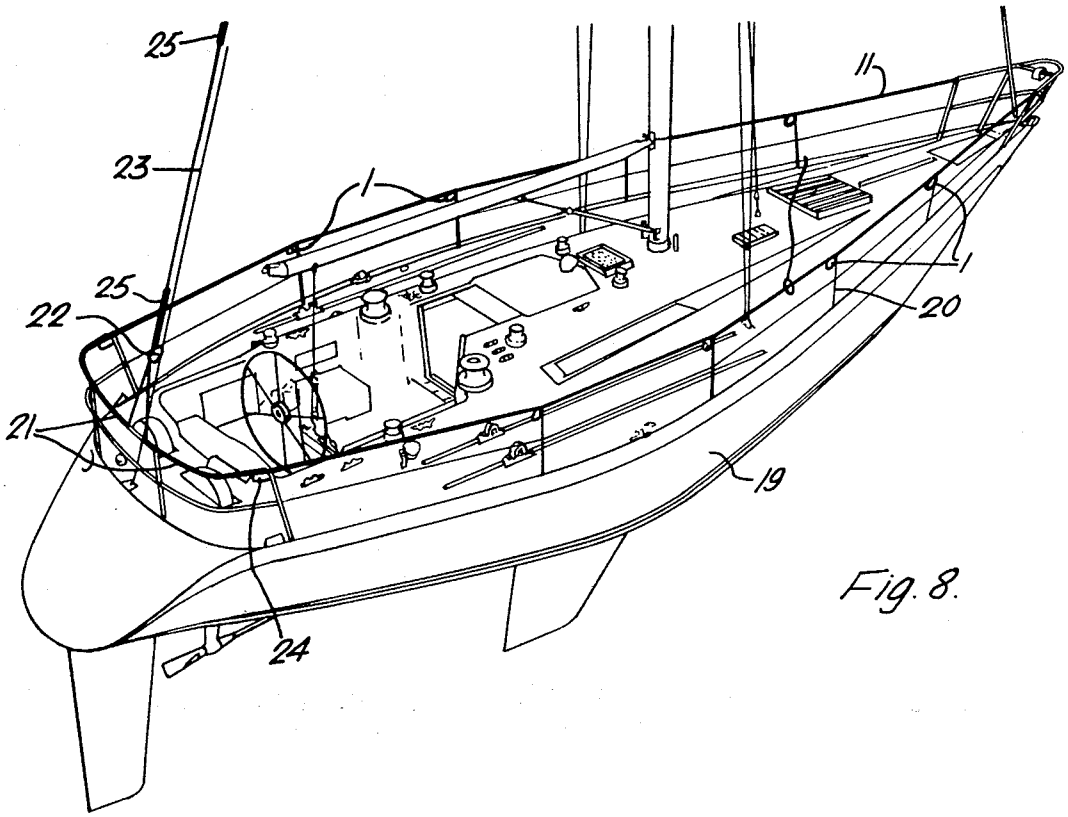
FIGS. 8 and 9 illustrate safety equipment according to the invention mounted on a yacht.
Figure 9:
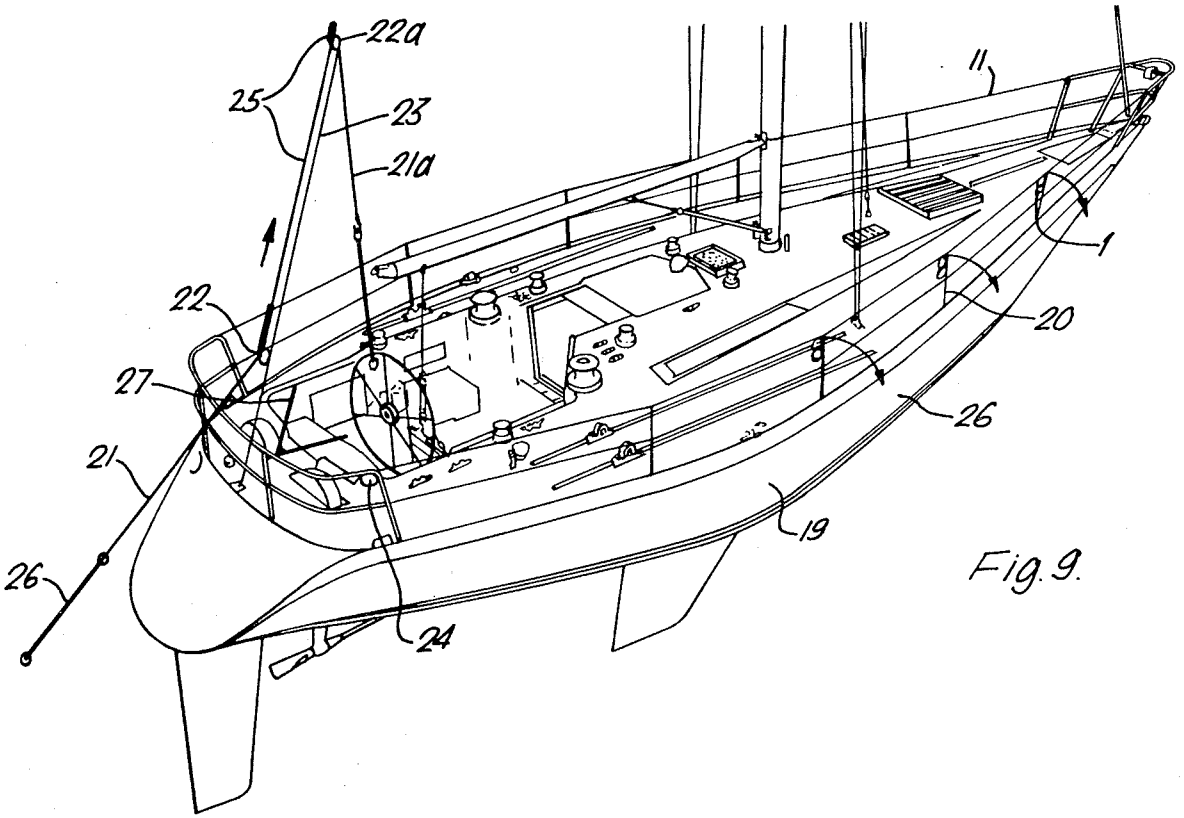

FIGS. 8 and 9 of the accompanying drawings show perspective views of a boat with the safety gear of the invention installed. The boat 19 is fitted with stanchions 20 at intervals along both sides and each stanchion carries a traversing device 1 through which a life-line 11 is passed. A pendant 21 is attached to the aftermost stanchion on each side, the other ends of the pendants being attached to a tow ring 22 secured to the backstay 23. A device 24 for transferring the lanyard hook from the life-line to a pendant is provided at the said stanchions and a hoist system 25 is provided on the said back stay. In FIG. 9 it is shown how the traversing device topple to a lower position when a person goes overboard and the position of a person overboard deployed to the tow ring via the pendant and harness lanyard 26 being towed with an upward component which helps to keep the head above the water. The movement of the tow ring 22 on the hoist 25 is also shown with part of the downhaul 27 of the hoist leading into the cockpit which downhaul is operated manually or automatically on a signal when the pendant breaks away from the stanchion. Reference numeral 21*a* and 22*a* show the pendant and tow ring respectively in the recovered position.

Figure 10:
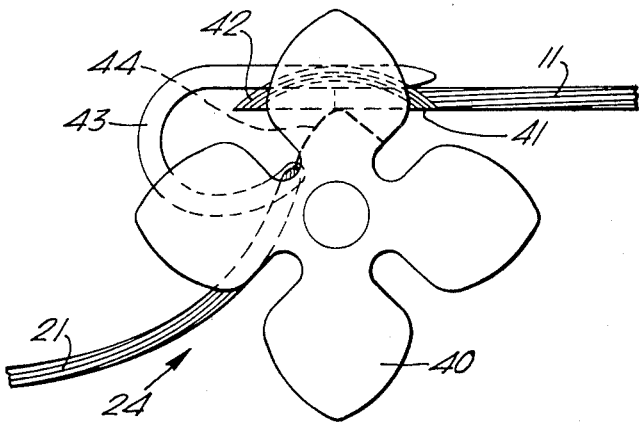
FIG. 10 shows a hook transfer device of the equipment of FIGS. 8 and 9.

FIG. 10 shows one form of hook transfer device 24, which comprises a four-leaf self indexing traversing device 40 which has two spaced wheels and is mounted in a casing (not shown) on a boat stanchion so that it can topple in a similar fashion to the traversing device shown in FIGS. 5 and 6. A ratchet device is provided between the traversing device and the casing which prevents rotation of the traversing device in a clockwise direction as viewed in FIG. 10. The guide member 41 of the traversing device has arcuate grooves 42 in its opposite faces which are engaged by arcuate projections on opposed faces of the aligned leaves or projections of the traversing device wheels so that the wheels can rotate relative to the guide member. One end of the life-line 11 extends into a bore in the guide member and is secured therein. A towing pendant 21 is secured at its free end to a transfer hook 43 which is freely located between the wheels of the traversing device with a straight portion of hook engaged in a groove provided in the upper face of the guide member 41. At its other end the hook 43 has a spring clip 44 which resiliently bears against the underside of the guide member to provide a frictional location of the hook in the traversing device until it is engaged by a lanyard attachment device. When a person goes overboard and the lanyard hook slides along the life-line 11 to engage traversing device 40, the lanyard hook rotates the wheels of latchway 40 allowing it to pass from the life-line over the guide member 41 and to engage transfer hook 43 thereby detaching the hook from the traversing device. When so detached the spring clip 44 serves to retain the hook to hook engagement.

This type of safety equipment is particularly suitable for single handed sailing craft where a winch recovery is used. A similar rig can be used for other craft where a winch recovery is not used, e.g. in motor boats, and the rotation of the latchway by passage therethrough of a lanyard hook can be used to trigger various actions, e.g. release of a dinghy, lifebuoy, ladder or flare.

Figure 11:
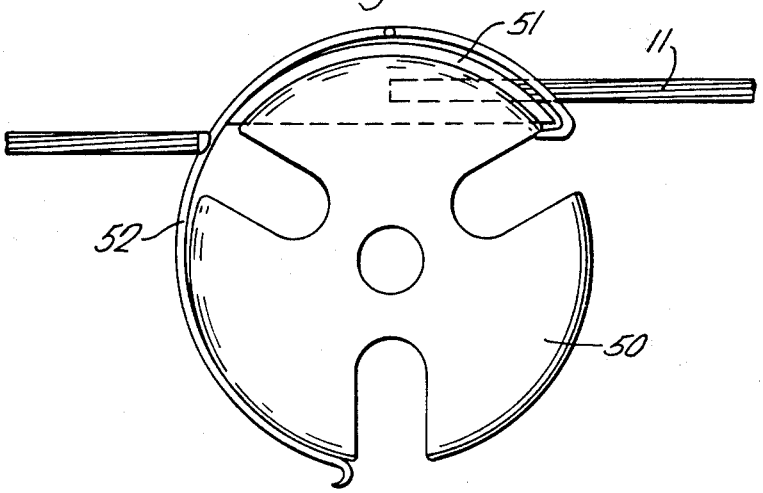
FIG. 11 shows another hook transfer device for the equipment of FIGS. 8 and 9.

FIG. 11 shows another transfer hook device which comprises a traversing device 50 which has two spaced wheels and is mounted in a casing (not shown) which in turn is pivotally mounted on a boat stanchion to allow the latchway to topple. In the construction, the guide member 51, to which one end of the life-line 11, is held in position between the wheels of the traversing device by the transfer hook device 52 which is in the form of a resilient element which embraces a portion of the periphery of the traversing device. When a lanyard hook passes through the traversing device to engage the transfer hook, which is then removed from the traversing device, the guide member 51 is also released from the traversing device. In this construction there is also a ratchet mechanism between the traversing device and its casing to prevent rotation of the traversing device in a clockwise direction.

Figure 12:
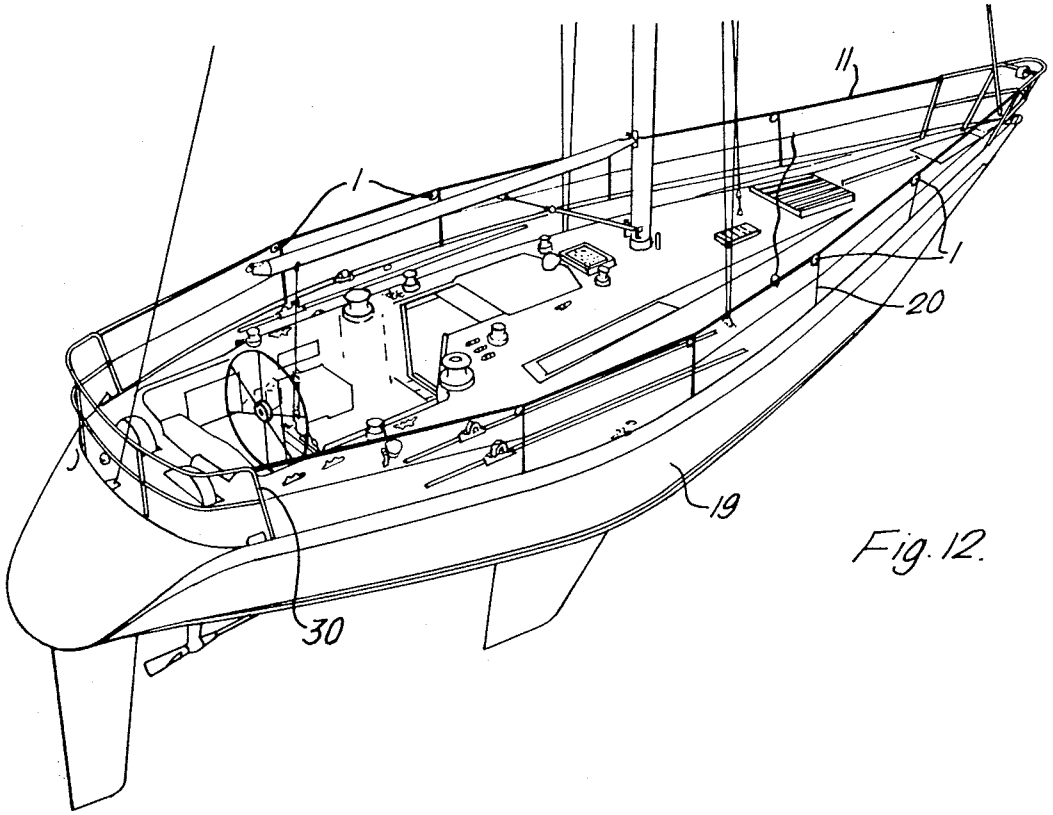
FIG. 12 shows another embodiment of the invention.

The embodiment shown in FIG. 12 is similar to that shown in FIGS. 8 and 9 except that no towing pendants are provided at the stern of the boat. This embodiment is suitable for use on boats having a plurality of crew members. The water drag on a person overboard will cause the lanyard to move aft along the life-line past its intermediate attachment points. On reaching a stanchion 30 to which one end of the life-line is secured, the lanyard attachment means, which may be a hook or similar device, or in other embodiments may be or include a traversing device, as described above, is secured at that stanchion so that the person overboard is towed with an upward component to help keep his head out of the water. The person overboard can then be hauled inboard from this towed position by the other crew members.

What is claimed is:

1. Safety equipment for a boat, which equipment comprises:

(a) a life-line for location along a peripheral portion of a boat, (b) support means for rigidly securing the life-line to a boat at a plurality of points along the length of the life-line to hold the line so as to conform to any configuration required by marine design, to which life-line a person can be attached by means of a safety harness, (c) a traversing device at each end and each intermediate attachment point of the life-line for attaching the life-line to the support means while allowing a lanyard attachment means engaged with the life-line to traverse freely each intermediate attachment point in either direction whether the wearer is inboard or overboard, each traversing device comprising:

(i) a rotatable wheel which is formed with several recesses in its periphery, the recesses being evenly spaced around the wheel and adjacent recesses being separated by a projecting part of the wheel, (ii) a co-operating guide member supported at a peripheral part of the wheel, and adapted to allow rotation of the wheel about its axis with respect to the guide member while locating the life-line with respect to the wheel whereby a lanyard attachment can be received, guided and passed through the traversing device in recesses of said wheel which rotates relative to said guide member, (d) at least one towing pendant secured at a first end thereof with respect to the boat for towing a person overboard astern of the boat in a head-up position;

(e) latching means at a second end of the pendant in detachable engagement with a traversing device at an end of the life-line and positioned to receive and firmly engage a lanyard attachment engaged with the life-line when such lanyard attachment reaches that traversing device when a person goes overboard, whereupon the second end of the pendant detaches from that traversing device to tow the person astern of the boat as aforesaid.

2. Safety equipment as claimed in claim 1 wherein said latching means comprises a generally hook-shaped element which, before use of the pendant, is positioned to embrace the guide member of a traversing device at one end of the life-line which end is secured to that guide member, the hook-shaped element having a resilient latching element on a first arm of the hook-shaped element for resiliently engaging one side of that guide member with the second arm of the hook-shaped element located firmly against the opposite side of the guide member so that when a person goes overboard the lanyard attachment slides along the life-line over the guide member to which said end of the life-line is secured to be engaged by the hook-shaped element and held thereon by the resilient latching element.

3. Safety apparatus as claimed in claim 1 wherein each intermediate traversing device is mounted on a support by pivotal means adapted to allow the traversing device to topple outwardly and downwardly of a boat when the life-line is subjected to the drag force of a person overboard attached to the life-line.

* * * * *

UNITED STATES PATENT AND TRADEMARK OFFICE

CERTIFICATE OF CORRECTION

PATENT NO. : 4,313,236

DATED : February 2, 1982

INVENTOR(S) : Alan W. Tupper, et al.

It is certified that error appears in the above-identified patent and that said Letters Patent are hereby corrected as shown below:

Column 8, line 3: "claim 1" should be

--claim 2--

Signed and Sealed this

*Twenty-fifth* Day of *May 1982*

[SEAL]

*Attest:*

GERALD J. MOSSINGHOFF

*Attesting Officer*

*Commissioner of Patents and Trademarks*